United States Patent [19]

Lajoye

[11] Patent Number: 4,549,339

[45] Date of Patent: Oct. 29, 1985

[54] APPARATUS AND METHOD FOR MANUFACTURE OF CURVED HOLLOW TOROIDAL ELEMENTS

[76] Inventor: Pierre Lajoye, 40 Rue de la Vacquiniere, Montigny les Metz (Moselle), France

[21] Appl. No.: 479,308

[22] Filed: Mar. 28, 1983

[51] Int. Cl.[4] ..... B22D 13/00; B22D 11/126; B22D 13/06

[52] U.S. Cl. ..... 29/527.6; 164/114; 164/295; 164/289; 164/287

[58] Field of Search ..... 29/527.6; 164/114, 295, 164/286, 287, 289

[56] References Cited

U.S. PATENT DOCUMENTS 3,914,851 10/1975 Ujiie ..... 29/527.6
3,927,450 12/1975 Sommer et al. ..... 29/527.6
3,929,182 12/1975 Amado, Jr. ..... 164/287

FOREIGN PATENT DOCUMENTS 2124 1/1967 Japan ..... 164/114

*Primary Examiner*—Howard N. Goldberg
*Assistant Examiner*—V. K. Rising
*Attorney, Agent, or Firm*—Remy J. VanOphem

[57] ABSTRACT

A method and an apparatus for manufacturing a hollow curved member, especially a curved pipe as well as the curved member or pipe produced by the method and apparatus. A blank is formed by rotating fluid material in a mold having a toroidal cavity about an axis displaced a predetermined distance from the mean longitudinal axis of the cavity and solidifying the fluid material. The blank is removed from the mold and a toroidal inner surface is machined into the blank so as to provide a passageway therethrough. In the preferred embodiment, the toroidal cavity is circular in cross-section and has a circular arcuate axis and the inner surface is machined into the blank coaxial with the outer surface of the blank.

20 Claims, 10 Drawing Figures

Fig 7
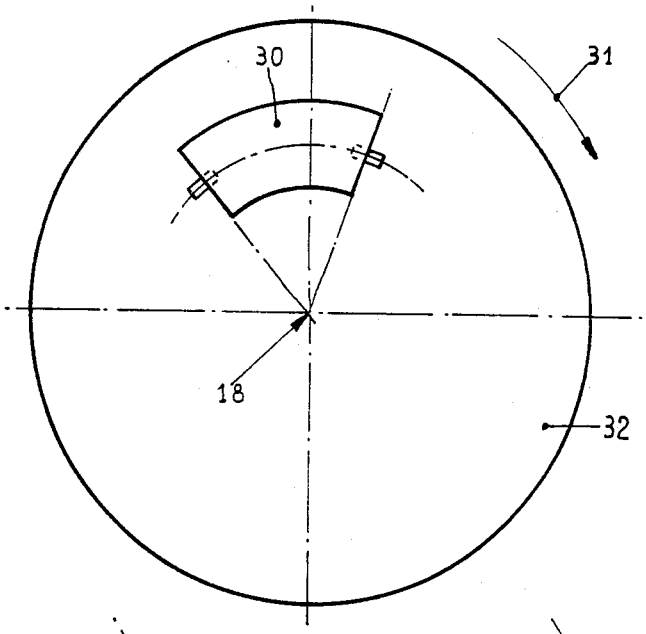
Fig 9
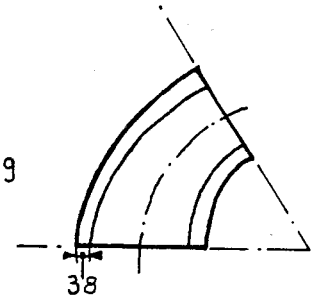
Fig 10
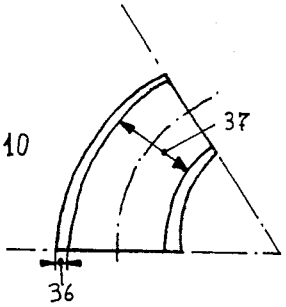
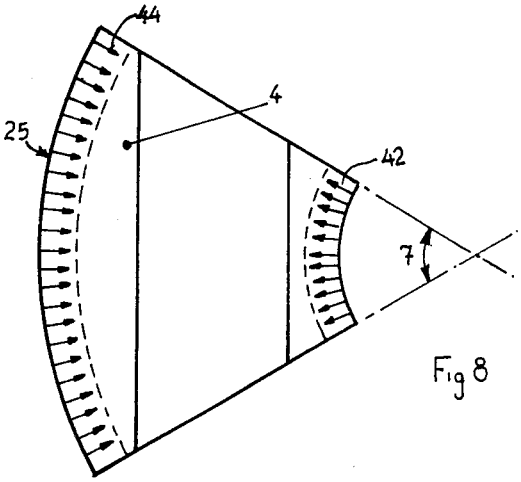
Fig 8

APPARATUS AND METHOD FOR MANUFACTURE OF CURVED HOLLOW TOROIDAL ELEMENTS

BACKGROUND OF THE PRESENT INVENTION

The present invention is directed to the manufacture of a bent portion of a pipeline and, in particular to a pipeline having a large cross-sectional measurement. Pipelines of this type are used in civil engineering or public works, for example, for the construction of thermal or nuclear power stations.

The manufacture of curved pipes or bends, that is, the manufacture of hollow toroidal segments of circular cross-section and of various thicknesses which are used together with cylindrical pipelines presents difficulties, especially if the constituent material is a metal and if the environmental stresses to which they are subjected, such as pressure, fatigue, and corrosion are high.

Several techniques are currently used for manufacturing these curved pipes. For example, these curved pipes may be formed using traditional molding processes, namely sand molding or chill casting, with a core. Alternatively, these curved pipes may be formed by mechanical bending of tube elements under the action of heat or in the cold, by bending using electrical induction, by hot deformation by the forging of tubular pieces, or by welding of stamped shells.

The continuity of the toroidal wall is sometimes sacrificed by welding together sections of welded or seamless tube elements, to the detriment of the quality of the flow of the fluid to be conveyed therethrough.

Apart from traditional molding, whose technical limits result from the severity of the specifications, the other methods consist of deforming the constituent material of a tube. This leads, in the majority of cases, to a lack of homogeneity in the thickness of the walls and also to damage to the original structure of the material. Alternatively, this introduces numerous welds into a portion of piping which is already particularly sensitive to erosion, pitting, corrosion and so on, because of the deflection of the stream of fluid running through it.

The present invention provides a method which overcomes the above recited disadvantages by combining the techniques of centrifugation of materials in the liquid phase and the techniques of machining these same materials in the solid phase.

Furthermore, the present invention makes it possible to produce very thick curved pipes capable of withstanding high stresses without damage to the structure obtained during the initial shaping, except the stresses resulting from the heat treatments frequently applied to materials and, in particular, to metal materials, after solidification.

It is known that centrifugation under high acceleration provides the materials produced in this way with good characteristics and an exceptional internal constitution.

In fact, the density differences between these materials in the liquid state and the impurities which could be present therein in the form of inclusions are considerably increased by the centrifugal force. The impurities are thus thrown out, either towards the bore in the centrifuged hollow body, under the influence of the Archimedean thrust, or towards the periphery, under the influence of the centrifugal force, depending on whether they are more or less dense than the material in question.

The dissolved gases are also excluded from the liquid mass under the influence of the pressure difference between the ambient environment, generally the atmosphere and the body of the liquid subjected to the centrifugal force before and during its solidification.

For the same reasons, the centrifuged materials also possess no pores.

If the processing and the centrifugation of these materials are carried out correctly, they are capable of withstanding high pressures because of their noteworthy water tightness.

A centrifuged body can be given any desired external shape, provided that this shape enables it to be released from the mold, which is virtually always made of metal, either directly or by splitting the mold.

However, the bore in this body will theoretically be either a cylinder or revolution, if the centrifugation axis is horizontal, or a portion of a paraboloid of revolution, if the centrifugation axis is vertical. The axis of symmetry of both these surfaces is identical to the axis of rotation of the mold. The paraboloid of revolution is closer to a cylinder of revolution, as the centrifugal force increases relative to the earth's gravity.

The internal and external surfaces of a circular cross-section are two curved pipe toroids with the same center and the same mean radius. The thickness to be obtained is equal to the difference in radius of the concentric circular sections of the external surface and the internal surface.

The novel method and apparatus according to the present invention makes it possible to obtain the external surface of the toroid by centrifugation, while the internal surface will be obtained by machining the crude surface, of virtually cylindrical shape, resulting from the centrifugal force.

As the principle is the same for both horizontal and vertical centrifugations, the application of the invention to the vertical centrifugation of a curved pipe bend will be described below. To simplify the account, it will be assumed that the centrifugation mold is made of metal, although it is understood that it could consist of any other appropriate material.

SUMMARY OF THE PRESENT INVENTION

The process according to the present invention for manufacturing a pipeline bend by centrifugal casting is characterized in that it includes the following stages in succession:

(a) a centrifugation mold which can be taken to pieces is used, in which the internal impression has the shape of the external surface of the bend to be produced;
(b) this mold is rotated about a geometrical axis which substantially coincides with the mean internal longitudinal axis of the bend to be produced;
(c) the molten material is cast into the rotating mold and then left to solidify;
(d) the mold is opened in order to release the blank of bend, the external surface of which is bent; and
(e) this blank is mounted on a machining device in order to machine the internal surface to give the final bent shape.

It is pointed out that, if appropriate, the external surface of the bend can be preserved as such, roughcast, that is to say without any external machining.

The process is further simplified if the bend to be produced has the shape of a hollow toroidal segement.

In this case, each meridian section is circular, while the mean longitudinal internal axis of the bend is also an arc of a circle. The blank can then be demolded by sliding it in an arc of a circle within the solid hollow body of the mold, only the two end faces of which can be removed like simple covers.

BRIEF DESCRIPTION OF THE DRAWINGS

The accompanying drawings, which are given by way of non-limiting example, will provide a better understanding of the characteristics of the invention.

FIG. 7 is a schematic view illustrating still another alternate step for machining the internal surface as well as the external surface of the blank according to the method of the present invention;

FIG. 8 is an equatorial sectional view of the blank, illustrating the progress of the solidification and the structure of the material within the finished curved pipe produced by the method of the present invention;

FIG. 9 is a longitudinal sectional view of a curved pipe of constant thickness, obtained according to the method of the present invention; and FIG. 10 is a longitudinal sectional view of a curved pipe of variable thickness, obtained according to the method of the present invention.

DETAILED DESCRIPTION OF THE PREFERRED EMBODIMENT

Figure 1:
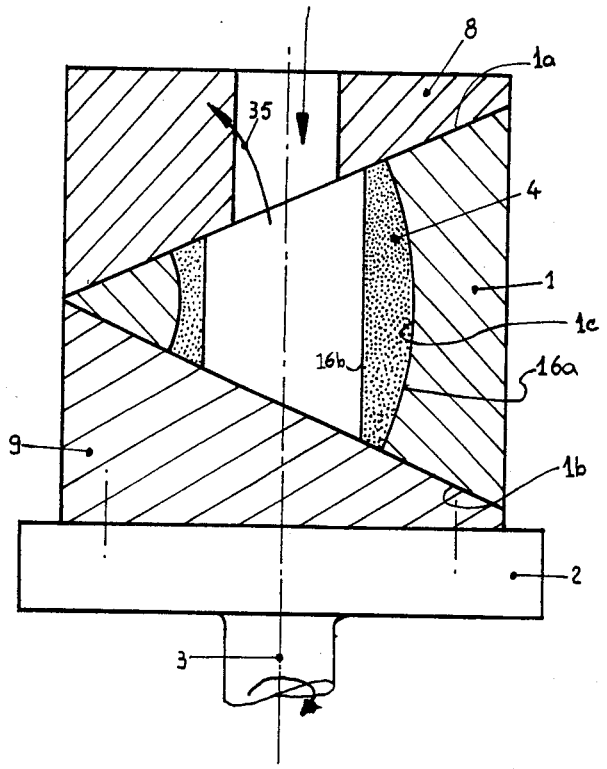
FIG. 1 is a partial axial sectional view showing a centrifugal mold for a pipe having a bend, according to the present invention.

FIG. 1 shows a mold 1 having a cavity 1*c* in the shape of a portion of a circular toroid of circular section, affixed to the horizontal plate 2 of a vertical centrifuging machine. Two end members or covers 8 and 9 bear against the ends 1*a* and 1*b* of the mold 1.

The plane of symmetry 40 of this portion of a circular toroid passing through its longitudinal axis is parallel to the plate of the machine.

Figure 2:
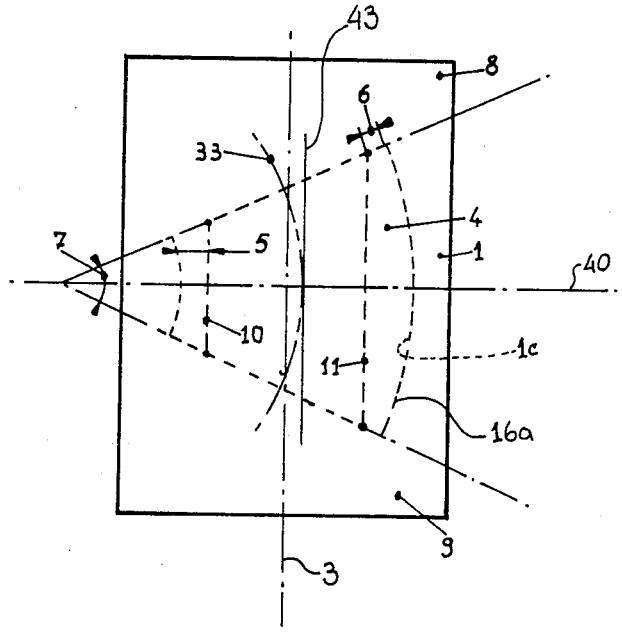
FIG. 2 is a diagrammatic view showing the method of machining the blank produced by the mold of FIG. 1 after it has been demolded, according to the method of the present invention.

It will be apparent to one skilled in the art that it is possible to pour into the cavity 1*c* a sufficient amount of liquid material to insure that the internal limit of the centrifuged molding or blank 4 is capable, after suitable machining of the inside of the solidified molding or blank, of having the desired toroidal internal surface (FIG. 2).

For this purpose, it is sufficient for the length of the segments 5 and 6 to be slightly greater than the final wall thickness of the curved pipe to be obtained.

It will also be readily apparent that the angle 7, defined between the two planes in which the end members or covers 8 and 9 bear against the ends of the mold 1, must be less than the value for which the generatrices 10 and 11 of the internal cylinder are theoretically identical. Of course, it is necessary to remain within these limiting values so that a considerable centrifugal force will be exerted on the material during its solidification.

Figure 3:
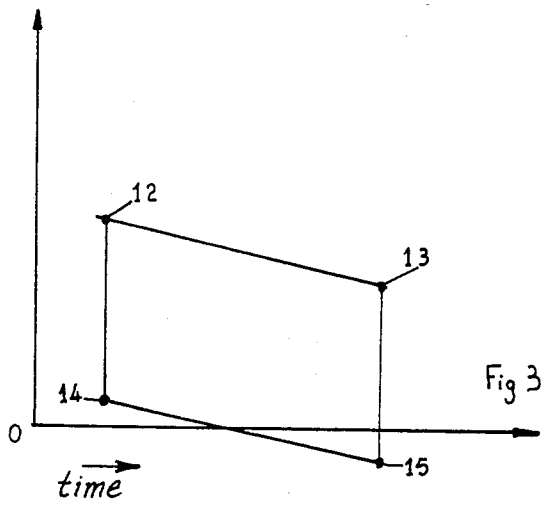
FIG. 3 is a graph illustrating the process for correcting the imbalance on the centrifugation mold, according to the method of the present invention.

FIG. 3 shows a graph in which the value of the imbalance of the rotating mass is plotted on the ordinate and the time is plotted on the abscissa.

It is seen that, before the material to be centrifuged is introduced into the mold 1, there is an imbalance 12 due to the fact that the center of gravity of the mold is offset from the axis of rotation 3 (FIGS. 1 and 2).

A new imbalance 13, in the same direction but of a smaller value, exists after the material has been introduced into the mold.

These imbalances can be partially corrected by reducing the mass of the mold 1 on the side opposite the convexity of the bend, so as to produce a pre-casting imbalance 14 and a post-casting imbalance 15 equal in value but opposite in direction, and each smaller in terms of absolute value than the initial imbalance 12 and the final imbalance 13 observed without this modification.

This static balancing operation can also be accompanied by dynamic balancing.

In any case, the centrifuging machine used must withstand, without suffering fatigue, the variable imbalances imposed by this process.

After solidification and after the end members or covers 8 and 9 have been opened, the centrifuged blank 4 can be released from the cavity 1*c*, without breaking the mold 1, by means of a circular sliding movement coinciding with the mean circle of the toroid as shown by arrow 35 in FIG. 1. After demolding, the blank 4, which has the shape illustrated in FIGS. 1 and 2, is machined. This operation consists firstly in converting the cylindrical internal surface 16*b* of the blank 4 to a toroidal surface parallel to the external surface 16*a* thereof and located at a distance from the external wall 16 which is equal to the desired thickness 17 assuming, of course, that the external surface 16*a* remains substantially as it is formed by centrifugation.

It should be noted that reference number 33 in FIG. 2 denotes the mean longitudinal internal axis of the toroid of which the bend or curved pipe to be produced constitutes a segment. FIG. 2 also shows a mean longitudinal axis 43 tangential to the curved longitudinal axis 33 at the midpoint.

Figure 4:
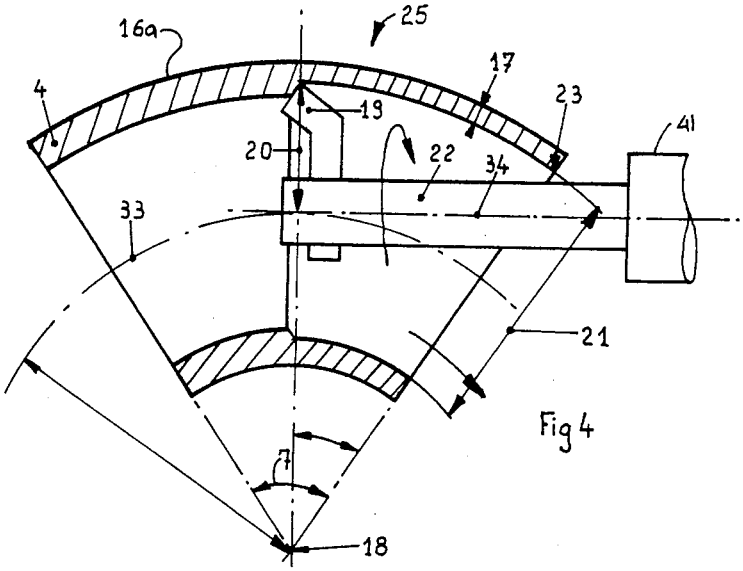
FIG. 4 is a sectional view through the blank and illustrates the step of machining the internal surface of a 60° bend in the blank according to the method of the present invention.
Figure 6:
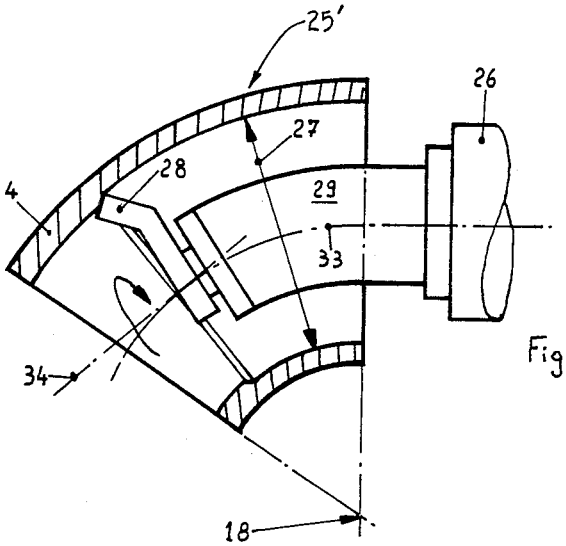
FIG. 6 is a view similar to FIG. 4 and illustrates an alternate step for machining the internal surface of the blank according to the method of the present invention.

As a circular toroid is the envelope of a circle rotating about an axis located in the plane of this circle, there are two possible ways in which the cylindrical internal surface 16*b* of the toroid can be machined. One example is illustrated in FIG. 4 and is described immediately below. Another example is illustrated in FIG. 6 and will be described later herein.

Referring now to FIG. 4, according to the method of the present invention, the blank 4 is locked parallel to the circular plane of the toroid on a machine tool 41. The horizontal plate of the machine tool 41 can rotate about the theoretical tordidal axis 18 of the toroid.

A cutting tool 19 is rotatably driven about the longitudinal geometrical axis of the machine tool 41 to machine the surface in the toroid by means of successive passes, the advancing movement then being caused by rotation of the plate about the toroidal axis 18 of the toroid. The tool 19 rotates about the longitudinal geometrical axis 34 of a tool carrier 22, the axis 34 being tangential to the mean longitudinal internal axis 33 of the toroidal bend.

This type of machining can be carried out on a boring machine or a milling machine fitted with a conventional plate or a cast-iron plate with controlled rotation.

The shape of the bend and the different relative values of the angle 7 of the bend, of the radius 20 of the bend and of the internal diameter 21 of the bend define the limits of the boring process described above. The tool carrier 22 abuts against the projecting edge formed by the face of the bend and its toroidal internal surface at the point 23 furthest from the center.

The operation can be continued by repeating the machining operation through the opposite orifice in the blank.

Figure 5:
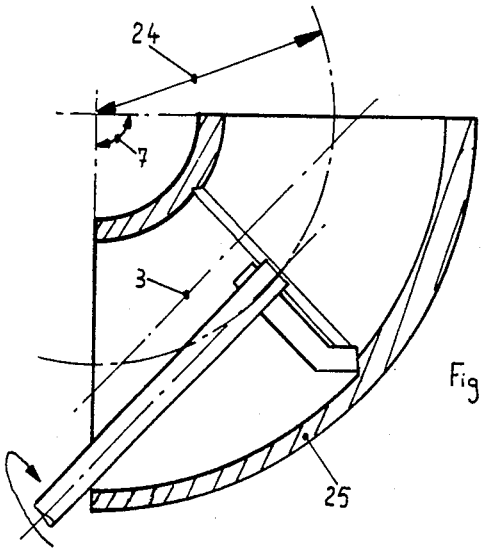
FIG. 5 is a view similar to FIG. 4 and shows an analogous operation for a 90° bend.

For example, the process can be used to machine the bore in a curved pipe 25 in which the angle 7 is equal to 90°, and of which the radius of curvature is equal to the internal diameter 24 (FIG. 5).

On the other hand, less sharp curves or bends, such as those having an angle 7 of 60° and having a radius of curvature in excess of three times the internal diameter, for example, cannot be machined internally by the above described process, even by gaining access to the bore successively through the two ends.

The present invention, therefore, includes an additional method and device which can be used either when the ends accessible by the above method have already been machined, or directly in order to carry out the entire operation. This device is illustrated in FIG. 6 and is described below.

FIG. 6 illustrates a curved pipe 25' in the shape of a toroid, the generating radius of which is the same as that of the bend and the diameter of which is less than the diameter 27 of the machined bore to be produced. The curved pipe blank is held at one of its ends by a frame, which is not shown in the drawing. At the other end of the blank, there is a drive head 26 equipped with a cutting tool 28, the cutting part of which describes the generating circle of the internal toroidal surface of the curved pipe. This curved arm 29 can be introduced by means of a circular movement, the advancing axis of which is identical to the toroidal axis 18, the guiding axis of which is identical to the mean longitudinal internal axis 33 of the toroid, into the bore to be machined, the tool thus generating the internal surface to be obtained. Conversely, with the curved arm 29 remaining fixed, the blank 4 of the bend can be locked on a rotating table as previously described.

In certain cases, it may be desired to also machine the exterior toroidal surface of the blank according to the method of the invention. For example, extra external thicknesses may have been created during centrifugation. It is possible to use a method similar to that described above, as depicted in FIG. 7, to machine the external surface of the blank using a cutting tool generating the external toroidal surface of the curved pipe by rotation around the latter, while rotating the blank in the direction of the arrow 31 about the toroidal axis 18 which causes the tool to advance along the toroidal surface.

It is, thus, possible to obtain a curved pipe of constant thickness 38, as illustrated in FIG. 9.

Still another variation of the method and apparatus of the present invention is contemplated for machining one or both of the toroidal surfaces of the blank to be used as a curved pipe.

The purpose of this variation is to obtain a curved pipe of variable wall thickness 36, as shown in FIG. 10, or alternatively of variable wall thickness and variable internal section 37.

To achieve this result, it is sufficient to combine the advancing of the tool or of the blank, as described earlier, with an apparatus for varying the bore diameter. This is possible, for example, to provide a surface with plateaus.

This variation provides curve restrictions with or without variation in wall thickness as depicted in FIG. 10. Of course, the centrifugation molds will have a shape corresponding to the external shape to be obtained on these blanks.

However, it is simpler in that case to consider the toroid as a surface of revolution and to produce the external surface by turning on a lathe, the circular shape being obtained, for example, with the aid of a reproducing device following a circular template, while the blank 30 is fixed to the face-plate 32 of a lathe as shown in FIG. 7.

It will be understood by one skilled in the art that the present invention has numerous advantages.

Apart from the fact that the material of the tube is centrifuged, which gives it an excellent internal constitution in all cases, it will be appreciated that there is an advantage peculiar to metal alloys centrifuged in a metal mold. The solidification of metal alloys obeys an imperative law. The solidification is unidirectional and, furthermore, involves the entire surface of the tube in a uniform and simultaneous manner. The arrows 44 and 42 in FIG. 8, in fact, show the progress of the solidification starting from the wall of the mold 1 demonstrating the fact that, despite the non-uniformity of the thicknesses of liquid metal after the metal has been introduced into the rotating mold or after the rotation of the metal already introduced in the static state into the mold has been started (according to the process chosen), all the points on the internal surface of the bend which are shown in broken lines are reached simultaneously by the solidification front progressing inwardly from the outside of the blank. As this internal surface is close to the external surface, the solidification takes place rapidly, and this gives the solidified alloy a particular fine-grained structure, which is always desirable for the high mechanical characteristics which result therefrom.

It is also known that centrifuged metal alloys possess isotropic, mechanical characteristics, that is, the properties are identical irrespective of the direction of the stresses.

The process described above, therefore, has considerable advantages over the conventional processes. For example, the prior art process involving hot deformation of forged or rolled tubes produces a fibrous structure with heterogeneous mechanical characteristics by the bulk machining of blanks, the solidification of which has not been directed logically from the external wall of the bend to be produced. Traditional molding also fails to produce the high mechanical characteristics expected of centrifuged products, and does not insure the homogeneity or isotropy of these same characteristics.

The above constitutes a detailed description of the present invention and is offered by way of example and not by way of limitation. Many variations and modifications will be apparent to those skilled in the art upon reviewing the present application. Such variations and modifications are intended to be within the scope of the claims appended hereto.

What is claimed as novel is as follows:

1. A method of manufacturing a hollow curved member comprising the consecutive steps of:

admitting a predetermined amount of fluid material into a mold having a cavity therein in the shape of a portion of a toroid having a curved longitudinal axis and a mean longitudinal axis tangential to said curved longitudinal axis at the midpoint thereof;

rotating said mold generally about an axis displaced a predetermined distance from said mean longitudinal axis such that said predetermined amount of fluid material becomes distributed in said cavity in the form of a hollow toroid of fluid material solidifying said fluid material in said rotating mold such as to form a blank having the shape of a hollow toroid having a toroidal outer surface, a cylindrical inner surface, and two opposing open ends;

removing said blank from said mold; and removing material from the inner surface of said blank such as to produce a toroidal inner surface therein.

2. The method of claim 1 wherein said hollow curved member comprises a curved pipe segment.

3. The hollow curved member produced by the method of claim 1.

4. The method of claim 1 wherein said mold is comprised of at least two pieces and further wherein said step of removing said blank from said mold comprises separating said pieces of said mold.

5. The method of claim 1 wherein said toroidal inner surface is coaxial with said toroidal outer surface.

6. The method of claim 1 wherein said toroidal cavity has a circular cross-section.

7. The method of claim 1 wherein said curved longitudinal axis is a circular arc.

8. The method of claim 7 wherein said step of removing said blank from said mold comprises sliding said blank along said circular arc.

9. The method of claim 7 wherein said toroidal cavity has a circular cross section and further wherein said step of removing material from said inner surface of said blank comprises advancing a rotating machining means into said hollow toroidal blank and providing relative movement between said machining means and said blank so as to effectively advance said machining means generally along said circular arc to produce an internal toroidal surface generally coaxial with said external toroidal surface.

10. The hollow curved member produced by the method of claim 9.

11. The method of claim 1 wherein said step of removing material from said inner surface of said blank further comprises simultaneously removing material from said external surface of said blank to produce coaxial surfaces.

12. A method of manufacturing a curved hollow pipe segment having a uniform wall thickness and a uniform density along the curved wall thereof, said method comprising the consecutive steps of:

admitting a predetermined amount of fluid material into a mold having a mold cavity therein in the shape of a portion of a circular toroid having a first predetermined cross-sectional diameter, a circularly arcuate longitudinal axis, and a mean longitudinal axis tangential to said curved longitudinal axis at the midpoint thereof;

rotating said mold generally about an axis displaced a predetermined distance from said mean longitudinal axis such that said predetermined amount of fluid material becomes distributed in said mold cavity in the form of a hollow toroid of homogeneously distributed fluid material;

solidifying said fluid material in said rotating mold so as to form a blank having the shape of a hollow circular toroid having a circular toroidal outer surface, a circular cylindrical inner surface, an internal cavity defined by said inner surface, and two opposing open ends opening into said internal cavity;

removing said blank from said mold cavity by providing relative angular motion therebetween along said circularly arcuate longitudinal axis;

abutting against one of said opposing ends a rotating machining means for machining a bore having a second predetermined diameter less than said first predetermined diameter; and providing relative motion between said rotating machining means and said blank generally along said circularly arcuate longitudinal axis so as to remove material from said inner surface and to produce a circular toroidal inner surface generally coaxial with said outer surface.

13. The hollow curved pipe segment produced by the method of claim 12.

14. The method of claim 12 wherein said step of removing material from said inner surface of said blank further comprises simultaneously removing said blank to produce coaxial surfaces.

15. The method of claim 12 wherein said relative motion between said machining means and said blank is substantially along said circularly arcuate longitudinal axis so as to remove material from said inner surface and to produce a circular toroidal inner surface substantially coaxial with said outer surface.

16. Apparatus for producing a curved hollow element having a uniform density along the curved wall thereof, said apparatus comprising:

a mold having a mold cavity therein in the shape of a portion of a toroid having a curved longitudinal axis and a mean longitudinal axis tangential to said curved longitudinal axis at the midpoint thereof;

means for admitting a predetermined amount of fluid material into said mold cavity;

means for rotating said mold about a rotational axis displaced a predetermined distance from said mean longitudinal axis such that upon selective operation of said means for rotating said mold, said predetermined amount of fluid material becomes distributed in said cavity in the form of a hollow toroid of fluid material;

means for solidifying said fluid material in said rotating mold such as to form a blank having the shape of a hollow toroid and having a toroidal outer surface centered on said curved longitudinal axis and a circular cylindrical inner surface centered on said rotational axis; and means for removing said blank from said mold.

17. The apparatus of claim 16 wherein said curved longitudinal axis forms a circular arc and further wherein said toroidal mold cavity has a constant circular cross-section having a first predetermined diameter, and further wherein said means for removing said blank from said mold comprises a removable end member interconnected with said mold to close one longitudinal end of said mold cavity such that said blank may be rotated along said circular arc to remove said blank from said cavity.

18. The apparatus of claim 16 further comprising means for removing material from said inner surface of said blank such as to produce a toroidal inner surface therein.

19. Apparatus for producing a curved hollow element of uniform wall thickness from a blank having a circular toroidal outer surface defined by a circular longitudinal axis, and having a passageway therethrough, said apparatus comprising:

machining means insertable into said cavity;

rotating means for rotating said machining means such that said machining means machines an annular portion of material from said blank; and advancing means for providing relative movement between said machining means and said blank generally along said circular longitudinal axis such that said machining means machines a toroidal inner surface in said blank generally coaxial with said outer toroidal surface.

20. The apparatus of claim 19 further comprising second machining means for machining the external surface of said blank simultaneously with the machining of said internal surface by said first mentioned machining means.

* * * * *

UNITED STATES PATENT AND TRADEMARK OFFICE

CERTIFICATE OF CORRECTION

PATENT NO. : 4,549,339

DATED : October 29, 1985

INVENTOR(S) : Pierre LaJoye

It is certified that error appears in the above-identified patent and that said Letters Patent is hereby corrected as shown below:

Column 4, Line 61, delete "tordidal" and insert ---- toroidal ----.

Signed and Sealed this

*Twentieth* Day of *May 1986*

[SEAL]

*Attest:*

DONALD J. QUIGG

*Attesting Officer*

*Commissioner of Patents and Trademarks*